US006056793A

United States Patent [19]

Suppes

[11] Patent Number: 6,056,793

[45] Date of Patent: May 2, 2000

[54] BLENDED COMPRESSION-IGNITION FUEL CONTAINING LIGHT SYNTHETIC CRUDE AND BLENDING STOCK

[75] Inventor: Galen J. Suppes, Lawrence, Kans.

[73] Assignee: University of Kansas Center for Research, Inc.

[21] Appl. No.: 09/179,238

[22] Filed: Oct. 26, 1998

Related U.S. Application Data

[60] Provisional application No. 60/063,310, Oct. 28, 1997, provisional application No. 60/067,554, Dec. 5, 1997, and provisional application No. 60/085,937, May 19, 1998.

[51] Int. Cl.[7] ..... C10L 1/18

[52] U.S. Cl. ..... 44/446; 44/448; 44/451

[58] Field of Search ..... 44/446, 451

[56] References Cited

U.S. PATENT DOCUMENTS

| | | | |
|---|---|---|---|
| 2,660,032 | 11/1953 | Rosenthal | 60/39.02 |
| 3,620,961 | 11/1971 | Ireland | 208/79 |

(List continued on next page.)

FOREIGN PATENT DOCUMENTS

| | | |
|---|---|---|
| 0 583 836 A1 | 2/1994 | European Pat. Off. . |
| 0 583 836 B1 | 10/1997 | European Pat. Off. . |

OTHER PUBLICATIONS

Q.A. Baker, "Use of Alcohol–in–Diesel Fuel Emulsions and Solutions in a Medium–Speed Diesel Engine," SAE 810254 (1981).

Pat Davies, "Opportunities for Gas Conversion in the Middle East," presented at the Middle East Petroleum and Gas Conference (1997).

James J. Eberhardt, "Future Fuels for Heavy–Duty Trucks," Alternative Fuels in Trucking, vol. 6, No. 2 (1997).

E. Eugene Ecklund et al., "State–of–the–Art Report on the Use of Alcohols in Diesel Engines," SAE 840118, presented at the International Congress & Exposition, Detroit, Michigan, Feb., 1984.

J.B. Heisey and S.S. Lestz, "Aqueous Alcohol Fumigation of a Single–Cylinder DL Diesel Engine," SAE 811208 (1981).

M. Kawanami et al., "Advanced Catalyst Studies of Diesel NOx Reduction for On–Highway Trucks," SAE 950154, presented at the International Congress & Exposition, Detroit, Michigan, Feb. 27–Mar. 2, 1995.

N. Khan and S.R. Gollahalli, "Performance and Emission Characteristics of a Diesel Engine Burning Unstabilized Emulsions of Diesel Fuel with Water, Methanol, and Ethanol," SAE 811210 (1981).

A. Lawson et al., "Heavy–Duty Truck Diesel Engine Operation on Unstabilized Methanol/Diesel Fuel Emulsions." SAE 810346 (1981).

D. Naber, "The Influence of Fuel Properties on Exhaust Emissions from Advanced Mercedes Benz Diesel Engines," SAE 932685 (not dated).

Paul W. Schaberg et al., "Diesel Exhaust Emission Using Sasol Slurry Phase Distillate Process Fuels," SAE 972898, presented at the International Falls Fuels & Lubricants Meeting & Eposition, Tulsa, Oklahoma, Oct. 13–16, 1997.

(List continued on next page.)

*Primary Examiner*—Ellen M. McAvoy
*Attorney, Agent, or Firm*—A.M. (Andy) Arismendi, Jr.

[57] ABSTRACT

This invention is a composition of matter useful as a compression-ignition fuel. The composition has from about 30 to about 95 mass % of a light synthetic crude or syncrude, preferably from Fischer-Tropsch synthesis or related processes, and from about 5 to about 70 mass % of a blending stock that improves one or more desirable fuel property(s) including but not limited to pour point temperature, viscosity and emissions generated during combustion in a diesel engine. The blend stock preferably has an average molecular weight less than the average molecular weight of the light syncrude. Preferred blending stocks include hydrocarbons and oxygenates, such as alcohols, and ethers, having average molecular weights less than 200, preferably less than 160. The composition may optionally also contain pour point depressants, cetane improvers, carbon-containing compounds which react with water, and/or emulsifiers.

30 Claims, 2 Drawing Sheets

U.S. PATENT DOCUMENTS

| | | | |
|---|---|---|---|
| 3,784,364 | 1/1974 | Slater et al. | 48/215 |
| 3,866,411 | 2/1975 | Marion et al. | 60/39.02 |
| 3,868,817 | 3/1975 | Marion et al. | 60/39.02 |
| 3,926,785 | 12/1975 | Siegel | 208/211 |
| 3,928,000 | 12/1975 | Child et al. | 48/197 R |
| 3,932,288 | 1/1976 | Hoke | 252/33 |
| 3,968,999 | 7/1976 | Keller | 302/66 |
| 3,993,458 | 11/1976 | Antal, Jr. | 48/209 |
| 4,005,996 | 2/1977 | Hausberger et al. | 48/197 R |
| 4,027,688 | 6/1977 | Gruber et al. | 137/13 |
| 4,041,095 | 8/1977 | Kuo | 260/676 R |
| 4,041,096 | 8/1977 | Kuo | 260/676 R |
| 4,041,097 | 8/1977 | Ireland et al. | 260/676 R |
| 4,044,063 | 8/1977 | Ireland et al. | 260/676 R |
| 4,044,064 | 8/1977 | Milstein et al. | 260/676 R |
| 4,046,829 | 9/1977 | Ireland et al. | 260/676 R |
| 4,046,831 | 9/1977 | Kuo | 260/676 R |
| 4,049,741 | 9/1977 | Kuo et al. | 260/676 R |
| 4,050,908 | 9/1977 | McNamee et al. | 48/210 |
| 4,059,648 | 11/1977 | Derr et al. | 260/676 R |
| 4,071,574 | 1/1978 | Milstein et al. | 260/676 R |
| 4,075,831 | 2/1978 | McGann | 60/39.05 |
| 4,076,612 | 2/1978 | Hollaway | 208/8 |
| 4,088,671 | 5/1978 | Kobylinski | 260/449.6 R |
| 4,110,082 | 8/1978 | Michaels-Christopher | 44/50 |
| 4,113,445 | 9/1978 | Gettert et al. | 48/197 R |
| 4,115,075 | 9/1978 | McNamee et al. | 48/197 R |
| 4,133,841 | 1/1979 | Cosyns et al. | 260/676 R |
| 4,134,907 | 1/1979 | Stephens, Jr. | 260/449.6 M |
| 4,140,602 | 2/1979 | Lewis et al. | 204/157.1 H |
| 4,147,456 | 4/1979 | Klass | 405/210 |
| 4,158,680 | 6/1979 | McGann | 261/149 |
| 4,159,237 | 6/1979 | Schmid | 208/10 |
| 4,159,897 | 7/1979 | Doehlert | 44/57 |
| 4,191,700 | 3/1980 | Lebowitz et al. | 260/449 M |
| 4,197,421 | 4/1980 | Steinberg | 585/733 |
| 4,211,540 | 7/1980 | Netzer | 48/202 |
| 4,239,499 | 12/1980 | Pfefferle | 48/197 R |
| 4,251,227 | 2/1981 | Othmer | 48/197 R |
| 4,260,841 | 4/1981 | Holland et al. | 585/319 |
| 4,263,125 | 4/1981 | Weil et al. | 208/8 R |
| 4,294,586 | 10/1981 | Cox, Jr. | 44/56 |
| 4,304,871 | 12/1981 | Brennan et al. | 518/717 |
| 4,336,125 | 6/1982 | Weil et al. | 208/8 R |
| 4,356,001 | 10/1982 | Sweeney et al. | 44/446 |
| 4,410,334 | 10/1983 | Parkinson | 44/446 |
| 4,413,064 | 11/1983 | Beuther et al. | 518/715 |
| 4,413,153 | 11/1983 | Garwood et al. | 585/304 |
| 4,430,096 | 2/1984 | Schnur et al. | 48/206 |
| 4,460,378 | 7/1984 | Di Pietro et al. | 44/54 |
| 4,481,012 | 11/1984 | Di Pietro et al. | 44/53 |
| 4,493,905 | 1/1985 | Beuther et al. | 502/325 |
| 4,509,953 | 4/1985 | Itow et al. | 44/446 |
| 4,518,485 | 5/1985 | La Pierre et al. | 208/89 |
| 4,556,645 | 12/1985 | Coughlin et al. | 502/66 |
| 4,568,663 | 2/1986 | Mauldin | 502/325 |
| 4,579,830 | 4/1986 | Coughlin | 502/66 |
| 4,585,897 | 4/1986 | Fields et al. | 568/409 |
| 4,594,172 | 6/1986 | Sie | 252/55 |
| 4,603,662 | 8/1986 | Norton et al. | 123/1 A |
| 4,605,680 | 8/1986 | Beuther et al. | 518/715 |
| 4,613,624 | 9/1986 | Beuther et al. | 518/715 |
| 4,617,283 | 10/1986 | Coughlin | 502/66 |
| 4,617,320 | 10/1986 | Coughlin et al. | 518/719 |
| 4,645,585 | 2/1987 | White | 208/58 |
| 4,652,538 | 3/1987 | Rabo et al. | 502/66 |
| 4,663,355 | 5/1987 | Coughlin | 578/713 |
| 4,670,475 | 6/1987 | Mauldin | 518/715 |
| 4,678,723 | 7/1987 | Wertheim | 429/17 |
| 4,695,670 | 9/1987 | Seddon | 585/533 |
| 4,705,532 | 11/1987 | Mazanec et al. | 44/53 |
| 4,717,465 | 1/1988 | Chen et al. | 208/111 |
| 4,717,702 | 1/1988 | Beuther et al. | 502/303 |
| 4,743,354 | 5/1988 | Ward | 208/59 |
| 4,772,634 | 9/1988 | Farooque | 518/704 |
| 4,833,170 | 5/1989 | Agee | 518/703 |
| 4,846,959 | 7/1989 | Kennedy et al. | 208/97 |
| 4,906,351 | 3/1990 | Pellet et al. | 208/111 |
| 4,906,671 | 3/1990 | Haag et al. | 518/713 |
| 4,923,841 | 5/1990 | Hamner et al. | 502/230 |
| 4,960,504 | 10/1990 | Pellet et al. | 208/411 |
| 4,999,030 | 3/1991 | Skinner et al. | 48/197 R |
| 5,021,148 | 6/1991 | Meyer et al. | 208/431 |
| 5,048,284 | 9/1991 | Lywood et al. | 60/39.02 |
| 5,189,232 | 2/1993 | Shabtai et al. | 585/14 |
| 5,191,142 | 3/1993 | Marshall et al. | 585/640 |
| 5,295,350 | 3/1994 | Child et al. | 60/39.02 |
| 5,316,558 | 5/1994 | Gonzalez | 44/340 |
| 5,324,335 | 6/1994 | Benham et al. | 44/452 |
| 5,378,348 | 1/1995 | Davis et al. | 208/27 |
| 5,425,789 | 6/1995 | Lewtas et al. | 44/391 |
| 5,488,191 | 1/1996 | Chu et al. | 585/10 |
| 5,506,272 | 4/1996 | Benham et al. | 518/700 |
| 5,645,613 | 7/1997 | Benham et al. | 44/452 |
| 5,689,031 | 11/1997 | Berlowitz et al. | 585/734 |
| 5,733,941 | 3/1998 | Waycuilis | 518/703 |
| 5,750,759 | 5/1998 | Hagen et al. | 558/277 |
| 5,766,272 | 6/1998 | Lozzi | 44/324 |
| 5,766,274 | 6/1998 | Wittenbrink et al. | 44/436 |
| 5,782,936 | 7/1998 | Riley | 44/300 |
| 5,807,413 | 9/1998 | Wittenbrink et al. | 44/451 |
| 5,814,109 | 9/1998 | Cook et al. | 44/300 |
| 5,833,839 | 11/1998 | Wittenbrink et al. | 208/112 |

OTHER PUBLICATIONS

M. Signer, "European Programme on Emissions, Fuels and Engine Technologies (EPEFE) – Heavy Duty Diesel Study," SAE 961074, presented at the International Spring Fuels & Lubricants Meeting, Dearborn, Michigan, May 6–8, 1996.

Kent B. Spreen et al., "Effects of Cetane Number, Aromatics, and Oxygenates on Emissions From a 1994 Heavy–Duty Diesel Engine with Exhauster Catalyst," SAE 950250, presented at the International Congress & Exposition, Detroit, Michigan, Feb. 27–Mar. 2, 1995.

Terry L. Ullman et al., "Effects of Cetane Number, Cetane Improver, Aromatics, and Oxygenates on 1994 Heavy–Duty Diesel Engine Emissions," SAE 941020, presented at the International Congress & Exposition, Detroit, Michigan, Feb. 28 –Mar. 3, 1994.

Terry L. Ullman et al., "Effects of Cetane Number on Emission From a Prototype 1998 Heavy–Duty Diesel Engine," SAE 950251, presented at the International Congress & Exposition, Detroit, Michigan, Feb. 27–Mar. 2, 1995.

W.W. Lange et al., "Influence of Fuel Properties on Exhaust Emissions from Advanced Heavy–Duty Engines Considering the Effect of Natural and Additive Enhanced Cetane Number," SAE 972894, presented at the International Fall Fuels & Lubricants Meeting & Exposition, Tulsa Oklahoma, Oct. 13–16, 1997.

"Revolutionary products from Shell MDS," *Asian Oil & Gas*, pp. 16–20 (Mar. 1995).

BLENDED COMPRESSION-IGNITION FUEL CONTAINING LIGHT SYNTHETIC CRUDE AND BLENDING STOCK

RELATED APPLICATION

This Non-Provisional Patent Application claims benefit from (1) the Provisional Patent Application Ser. No. 60/063,310, filed on Oct. 28, 1997, entitled COMPRESSION-IGNITION FUEL COMPRISED MOSTLY OF SYNCRUDE, (2) the Provisional Patent Application 60/067,554, filed on Dec. 5, 1997, entitled SYNTHETIC COMPRESSION-IGNITION FUEL, and (3) the Provisional Application 60/085,937, filed May 19, 1998, entitled SYNTHETIC COMPRESSION-IGNITION FUEL CONTAINING ETHANOL AND ETHER, which are incorporated herein by reference.

FIELD OF INVENTION

The present invention relates to a composition of a fuel for compression-ignition engines. More particularly, the present invention relates to such a composition comprising a synthetic hydrocarbon liquid in a mixture with a blending stock.

BACKGROUND OF THE INVENTION

The growing importance of alternative energy sources and issues raised by stranded gas have brought a renewed interest in the Fischer-Tropsch synthesis, which is one of the more attractive direct and environmentally acceptable paths to high quality transportation fuels. Fischer-Tropsch synthesis involves the production of hydrocarbons by the catalyzed reaction of CO and hydrogen. Research involving the Fischer-Tropsch process has been conducted since the 1920's, and commercial plants have operated in Germany, South Africa and other parts of the world based on the use of particular catalysts.

U.S. Pat. No. 4,046,829 to Ireland et al. appears to disclose a process, wherein (in the process as modified) the product of Fischer-Tropsch synthesis is separated to recover a product boiling above and below about 400 degrees F., which is thereafter separately processed over different beds of ZSM-5 crystalline zeolite under conditions promoting the formation of fuel oil products and gasoline of higher octane rating. As disclosed therein, the unmodified process performed a separation of the Fischer-Tropsch synthesis product into various fractions: C2-, C3–C4, gasoline, fuel oil (diesel) and waxy oil.

U.S. Pat. No. 4,088,671 to Kobylinski appears to disclose the use of a ruthenium promoted cobalt catalyst on a support such as alumina or kielsguhr, in the synthesis of hydrocarbons from the reaction of CO and hydrogen at substantially atmospheric pressure. It was found that the addition of small amounts of ruthenium to a cobalt synthesis catalyst resulted in substantial elimination of methane from the product, together with the production of a more saturated, higher average carbon number. Aqueous solutions of metal salts were used to impregnate the support to prepare the catalyst thereof. The C9+ fraction was about 88% by weight, with the C19+ fraction being about 45% by weight. This fraction contains the portion of the synthetic crude, (or syncrude) which is normally solid at ambient temperatures (C20+) and is commonly referred to a wax, which leaves about 43% by weight in the diesel range.

Research was performed to reduce the waxy portion of the diesel fraction to minimize the effects of the wax coating the catalyst and thereby deactivating the catalyst and reducing the efficiency thereof. In one approach, dual catalysts were used in a single stage. U.S. Pat. No. 4,906,671 to Haag et al. appears to disclose a Fischer-Tropsch catalyst used in combination with a zeolite catalyst, wherein the zeolite catalyst selectively converted enough of the waxy product to prevent adhesion between catalyst particles which might interfere with catalyst flow thereby permitting maximization of diesel oil and heavy hydrocarbon yield. The diesel oil yield is disclosed to range from about 15 to about 45% by weight.

U.S. Pat. No. 4,652,538 to Rabo et al. appears to disclose the use of a dual catalyst composition in a single stage, wherein the composition is said to be capable of ensuring the production of only relatively minor amounts of heavy products boiling beyond the diesel oil range. The catalyst composition employed a Fischer-Tropsch catalyst together with a steam-stabilized zeolite Y catalyst of hydrophobic character, desirably in acid extracted form.

In another approach, the composition of the Fischer-Tropsch catalyst was modified to enhance diesel fuel boiling point range product.

U.S. Pat. Nos. 4,413,064 and 4,493,905 to Beuther et al. appear to disclose a catalyst useful in the conversion of synthesis gas to diesel fuel in a fluidized bed. The catalyst is prepared by contacting finely divided alumina with an aqueous impregnation solution of a cobalt salt, drying the impregnated support and thereafter contacting the support with a non-aqueous, organic impregnation solution of salts of ruthenium and a Group IIIB or IVB metal. The diesel fuel fraction (C9–C20) ranged from about 25 to about 57% by weight, with the C21+ fraction ranging from about 1 to about 9% by weight.

U.S. Pat. No. 4,605,680 to Beuther et al. appears to disclose the conversion of synthesis gas to diesel fuel and a high octane gasoline in two stages. In the first stage, the synthesis gas is converted to straight chain paraffins mainly boiling in the diesel fuel range. The diesel range fraction (C9–C20) ranged from about 44 to about 62% by weight, with the C21+ fraction ranging from about 4 to about 9% by weight. This first stage utilizes a catalyst consisting essentially of cobalt, preferably promoted with a Group IIIB or IVB metal oxide, on a support of gamma-alumina, eta-alumina or mixtures thereof. A portion of the straight chain paraffins in the C5–C8 range is separated and then converted in a second stage to a highly aromatic and branched chain paraffinic gasoline using a platinum group metal catalyst.

U.S. Pat. No. 4,613,624 to Beuther et al. appears to disclose the conversion of synthesis gas to straight chain paraffins in the diesel fuel boiling point range. The diesel range fraction ranged from about 33 to about 65% by weight, with the C21+ fraction ranging from nil to about 25% by weight. The catalyst consisted essentially of cobalt and a Group IIIB or IVB metal oxide on an alumina support of gamma-alumina, eta-alumina or mixtures thereof where the catalyst has a hydrogen chemisorption value of between about 100 and about 300 micromol per gram.

U.S. Pat. Nos. 4,568,663 and 4,670,475 to Mauldin appear to disclose a rhenium promoted cobalt catalyst, especially rhenium and thoria promoted cobalt catalyst, used in a process for the conversion of synthesis gas to an admixture of C10+ linear paraffins and olefins. These hydrocarbons can then be refined particularly to premium middle distillate fuels of carbon number ranging from about C10 to about C20. This Fischer-Tropsch synthesis product contains C10+ hydrocarbons in the amount of at least about 60% by weight (Examples thereof disclose about 80+% by weight). However, no distinction is made between the diesel and wax fractions thereof.

Among other things, the foregoing references do not disclose or teach how these hydrocarbons produced via Fischer-Tropsch synthesis would be formulated as a fuel nor how well they would perform.

U.S. Pat. No. 5,506,272 to Benham et al. appears to disclose several Fischer-Tropsch schemes using a promoted iron catalyst in a slurry reactor to produce oxygenated diesel and naphtha fractions on distillation that reduce particulate emissions in diesel engines. The Fischer-Tropsch synthesis product is separated into various fractions: tail gas, C5–C20 hydrocarbon product, water and alcohols, light wax and heavy wax. The C5–C20 product is generally a mixture of saturated and unsaturated aliphatic hydrocarbons. The C5–C20 hydrocarbon product can be employed as a substitute for diesel fuel and the like and hava high cetane numbers (about 62) thereof. The synthetic diesel fuel appeared to contain a distribution of C3–C19 alcohols and other oxygenates as a result of the Fischer-Tropsch synthesis. In one composition, the alcohols and oxygenates were each present in an amount of about 6% by weight. It was further disclosed that the enhanced emissions performance suggested that an oxygen-containing additive could be formulated which would produce improved performance. Additional diesel fuel may be prepared by cracking the wax portion of the Fischer-Tropsch synthesis product. This diesel product had a cetane number of about 73, but a low oxygen content (about 0.16%). The reference discloses that the two types of synthetic diesel produced thereby may be blended to increase the oxygen content of the mixture over the cracked product. The naphtha product thereof appeared to contain several oxygen-containing specie including C8–C12 alcohols (about 30%).

U.S. Pat. No. 5,807,413 to Wittenbrink et al. appears to disclose a synthetic diesel fuel with reduced particulate emissions. The diesel engine fuel is produced from Fischer-Tropsch wax by separating a light density fraction, e.g., C5–C15, preferably C7–C14, having at least 80+% by weight n-paraffins. The fuel composition appears to have comprised (1) predominantly C5–C15 paraffin hydrocarbons of which at least 80% by weight are n-paraffins, (2) no more than 5000 ppm alcohols as oxygen, (3) no more than 10% by weight olefins, (4) no more than 0.05% by weight aromatics, (5) no more than 0.001% by weight sulfur, (6) no more than 0.001% by weight nitrogen and (7) a cetane number of at least 60.

The addition of ethanol or similar blend stocks to petroleum-based diesel has been investigated by several researchers. Unlike mixtures of oxygenates with gasoline, mixtures of oxygenates with diesel appears to have not been accepted as providing performance advantages that justify commercialization.

Eckland et al (SAE Paper 840118) present a "State-of-the-Art Report on the Use of Alcohols in Diesel Engines". Techniques that have been evaluated for concurrent use of petroleum-based diesel and alcohols in a compression-ignition engine include (1) alcohol fumigation, (2) dual injection (3) alcohol/diesel fuel emulsions, and (4) alcohol/diesel fuel solutions.

Fumigation and dual injection require additional and separate fuel handling systems including additional injectors for either manifold injection (for fumigation) or direct injection. Accordingly, these alternatives represent both a significant incremental cost for vehicle production and increased operational inconvenience related to refilling two fuel tanks rather than one.

In the case of fumigation, Heisey and Lestz (SAE Paper 811208) report significant reductions in particulate generation; however, $NO_x$ generation increases. The incremental vehicular costs and increased $NO_x$ associated with fumigation have limited its acceptance.

The prominent embodiments of the present invention do not include fumigation or dual injection.

To maintain stable fuel emulsions of alcohol and diesel, large amounts of costly emulsifiers are required. Baker of the Southwest Research Institute (SAE Paper 810254) reported that 9:10 and 3:2 parts by volume of alcohol to emulsifier were required by methanol and ethanol, respectively to create stable emulsions. Emulsifiers are needed with methanol. They are needed with ethanol when the water content of ethanol is greater than about 0.5%.

Hsu (SAE Paper 860300) reports decreased $NO_x$ and smoke but increased hydrocarbon emissions with diesel-water emulsions. Likos et al (SAE Paper 821039) reports increased $NO_x$ and hydrocarbon emissions for diesel-ethanol emulsions. Khan and Gollahalli (SAE Paper 811210) report decreased $NO_x$ and hydrocarbon emissions with increased particulate emissions for diesel-ethanol emulsions. Lawson et al (SAE Paper 810346) report increased $NO_x$ and decreased particulate emissions with diesel-methanol emulsions.

The prominent embodiments of the present invention are not emulsions and thus have the advantage of not relying on the use of large amounts of expensive emulsifiers or mixing equipment.

Alcohol-diesel fuel solutions form a homogenous phase rather than two liquid phases as with emulsions. Methanol is not soluble in petroleum-based diesel, and so, most solution work has been performed with ethanol. A disadvantage of solutions is that two liquid phases form when the alcohol-diesel mixture is contacted with water. Although this can manifest into operating difficulties, similar problems occur with straight petroleum-based diesel is contacted with water.

Baker of the Southwest Research Institute (SAE Paper 810254) reports diesel-ethanol emulsions produce similar $NO_x$, hydrocarbon, and particulate emulsions as compared to baseline runs with straight diesel. Khan and Gollahalli (SAE Paper 811210) report increased particulate emissions with ethanol-diesel mixtures. Test results of ethanol-diesel solutions are inconclusive and mixed.

Many experienced automotive engineers associate a direct correlation between increases in alcohol fractions with increases in $NO_x$, and recognize that the chemically bound oxygen can lead to reductions in particulate emissions at the proper operating conditions. Since $NO_x$ emissions increase, advantages of ethanol-diesel emissions are limited, and such mixtures have not been generally accepted for widespread use by the market.

The prominent embodiments of the present invention are not mixtures with petroleum-based diesel. Furthermore, advantages of preferred mixtures of the present invention provide significant reductions in both $NO_x$ and particulate emissions. The preferred embodiments of this invention may also lead to increased hydrocarbon emissions; however, this is not considered a significant obstacle and such emissions may be reduced through optimization of the diesel fuel composition of the present invention.

Accordingly, there is a need for synthetic diesel fuels having the required physical, chemical and performance properties for use as a transportation fuel in diesel engines.

SUMMARY OF INVENTION

A compression-ignition fuel composition is provided, wherein the composition comprises from about 30 to about 95 mass % of a light syncrude and from about 70 to about 5 mass % of a blend stock, wherein the blend stock has an average molecular weight less than the average molecular weight of the light syncrude. The composition may optionally also contain a pour point depressant, a cetane improver, a carbon-containing compound which reacts with water, and/or an emulsifier. When present, the pour point depressant is present in amount less than 0.5 mass %.

In one embodiment of the present invention, the light syncrude is present as a major portion of the composition and the blend stock is present as a minor portion of the composition. In a preferred embodiment, the light syncrude ranges from about 60 to about 95 mass % of the composition and the blend stock ranges from about 5 to about 40 mass % of the composition. The light syncrude preferably has an average carbon number from about 8 to about 20 and a standard deviation around that carbon number of greater than 1.5 carbon numbers. The blend stock has preferably has an average molecular weight less than 200, and more preferably less than 160. The blend stock is preferably selected from the group consisting of hydrocarbons, oxygenates and combinations thereof.

The oxygenate is preferably selected from alcohols, ethers and combinations thereof. The alcohols and ethers preferably each have a carbon number less than 10. A preferred alcohol is ethanol. The ethers are any of those commonly used in gasoline formulations. A preferred ether is diethyl ether. When either an alcohol or ether is present, the alcohol or ether is preferably present in an amount ranging from about 5 to about 35 mass %. When the alcohol and ether are both present, they are preferably present in substantially equal mass amounts, with the total amounts thereof ranging from about 5 to about 40 mass %. When an oxygenate and a pour point depressant are both present, the pour point depressant is preferably present in an amount ranging from about 0.01 to about 0.05 mass %.

The cetane number of the composition is preferably greater than 35 and more preferably greater than 45. A cetane improver may be added to achieve the desired cetane number. When present, the cetane improver is preferably present in an amount ranging from about 0.01 to about 0.5 mass %. The cetane improver preferably has a greater solubility in ethanol than in hexane.

In order to minimize the adverse performance effects of a phase separation when water is present in the composition, an emulsifier may be added. In such a situation, the emulsifier is preferably present in an amount ranging from about 0.01 to about 0.5 mass %. In the alternative or in addition to the use of an emulsifier, a carbon-containing compound which reacts with water may be added. The carbon-containing compound is preferably an anhydride, more preferably acetic anhydride. When present, the anhydride is preferably present in an amount ranging from about 0.01 to about 0.5 mass %.

DETAILED DESCRIPTION OF THE INVENTION

Figure 1:
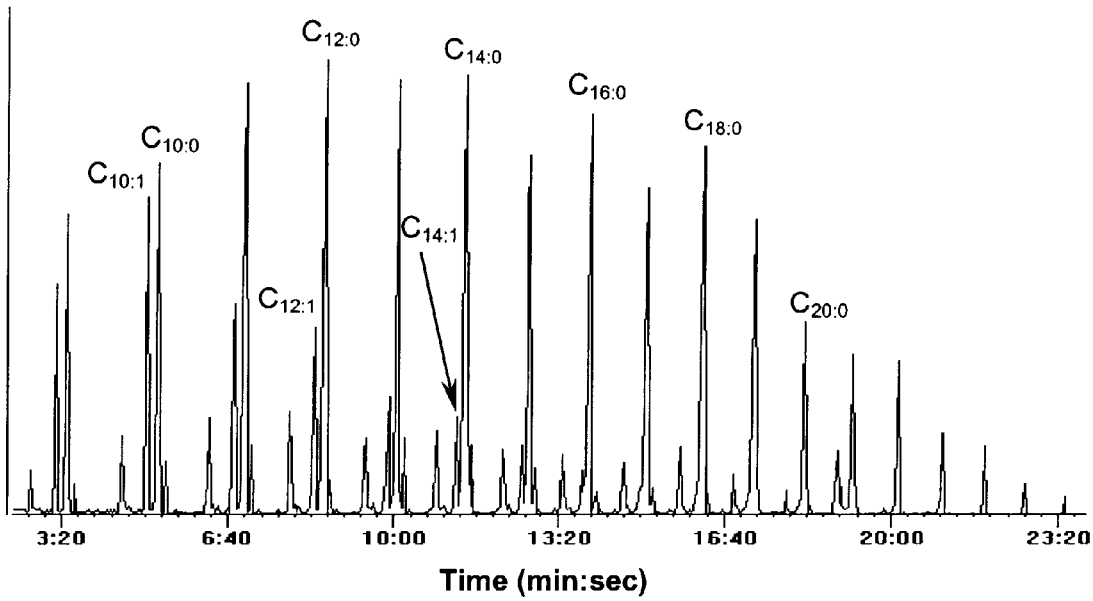
FIG. 1 is a GC-MS of a light syncrude used in the Examples hereof.

A compression-ignition fuel composition is provided, wherein the composition comprises from about 30 to about 95 mass % of a light syncrude and from about 70 to about 5 mass % of a blend stock, wherein the blend stock has an average molecular weight less than the average molecular weight of the light syncrude. The composition may optionally also contain a pour point depressant, a cetane improver, a carbon-containing compound which reacts with water, and/or an emulsifier.

Light Syncrude

Light syncrude may be defined as a mixture containing hydrocarbons produced from the polymerization of monomers produced for resources such as coal, biomass, natural gas, and carbon-containing refuse. More specifically, light sycrude is a mixture containing hydrocarbons having an aromatic carbon content less than 5% by mass. The light syncrude is a homogeneous liquid at about 15 to about 30° C. and one atmosphere of pressure. A preferred method of producing light syncrude is the Fischer-Tropsch polymerization of carbon monoxide and hydrogen. Preferably, light syncrude is liquid down to less than 5° C. The light syncrude preferably has an average carbon number from about 8 to about 20 and a standard deviation around that carbon number of greater than 1.5 carbon numbers. The light syncrude may contain oxygenates.

Fischer-Tropsch Synthesis

Fischer-Tropsch synthesis is a method of polymerizing synthesis gas (primarily carbon monoxide and hydrogen) into a mixture comprised mostly of hydrocarbon chains of varying length. Coal, biomass, and natural gas feedstocks can be converted to liquid fuels via processes including conversion of the feedstocks to synthesis gas followed by Fischer-Tropsch synthesis. Syncrude production from natural gas is generally a two step procedure. First, natural gas is converted to synthesis gas (predominantly carbon monoxide, hydrogen, and sometimes nitrogen). In the second step, the synthesis gas is polymerized to hydrocarbon chains through Fischer-Tropsch reactions. This typically produces a waxy syncrude comprised mostly of saturated hydrocarbons with carbon numbers between 1 and 100. The light hydrocarbons can be stripped out of the mixture as a vapor stream and recycled in the Fischer-Tropsch process leaving a product comprised mostly of $C_4$ to $C_{20}$ hydrocarbons—a paraffin range leading to excellent compression-ignition (CI) fuel properties. Up to about one third of the product can be $>C_{20}$ and is considered to have poor CI or spark-ignition (SI) fuel qualities. These higher carbon-number hydrocarbons tend to solidify at ambient temperatures.

Due to the waxy nature of Fischer-Tropsch syncrude, pour point temperatures can be a problem. Such syncrude may be sent through a third step where it is hydrocracked, reformed, and/or fractionated to diesel, kerosene, and naphtha. Published data has shown that this refined Fischer-Tropsch diesel has good performance properties including the generation of lower emissions than petroleum-based diesel fuel.

The composition of the present invention has many of the advantages of the refined Fischer-Tropsch diesel. Further, this invention allows a large fraction of the product (often having greater than 50% of its composition with carbon numbers between 10 and 16) of a Fischer-Tropsch synthesis process to be mixed with blend stocks and other additives for direct utilization as a compression-ignition fuel.

The light syncrude may be obtained by isolating the non-vapor portion of Fischer-Tropsch synthesis product, which is then separated into a fraction which is liquid at, for example, 20° C. (and ambient pressure) and a fraction which is largely not liquid a 20° C. (and ambient pressure). This liquid fraction is referred to herein as light syncrude. If the entire non-vapor portion of the Fischer-Tropsch product is liquid at 20° C. and one atmosphere of pressure, this liquid in its entirety may be used as light syncrude herein and separation of waxy components is not necessary. As noted above, the light syncrude is preferably a liquid at about 5° C. In this case, the waxy components are preferably removed.

The light syncrude useful as a component of the composition of the present invention may be obtained from the Fischer-Tropsch synthesis products such as those described in U.S. Pat. Nos. 4,088,671; 4,413,064; 4,493,905; 4,568,663; 4,605,680; 4,613,624; 4,652,538; 4,833,170; 4,906,671; 5,506,272; and 5,807,413, which are hereby incorporated by reference.

Blend Stocks

In addition to the use of pour point depressants, some embodiments of the present invention use blend stocks to reduce pour point temperatures. Blend stocks are believed to function by mechanisms different from that of pour point depressants. The effectiveness of blend stocks for reducing pour points are attributed to at least two mechanisms.

Firstly, in the absence of reducing the amount of precipitating solids, the blend stock increases the volume of liquid relative to precipitated solids and thus improves flow. Any liquid that mixes with the light syncrude will promote this type of pour point depression.

Secondly, when activity coefficients of the precipitating components are not substantially increased due to the addition of the blend stock to the liquid phase, the blend stock causes freezing point depression and reduces the amount of precipitating solids. Equation 1 shows the relation between freezing point depression and the activity ($\gamma_i x_i$) of the "waxy component" that precipitates from solution at lower temperatures. All blend stocks decrease the $x_i$, mole fraction, component of the activity. Since this activity ($\gamma_i x_i$) is a function of the liquid phase composition, the addition of a blend stock can change the activity ($\gamma_i x_i$).

$$\ln\gamma_1 x_1 = \frac{\Delta H^{fus}(T_m)}{R}\left[\frac{T_m - T_f}{T_m T_f}\right] - \frac{\Delta C_p}{R}\left[1 - \frac{T_m}{T_f} + \ln\left(\frac{T_m}{T_f}\right)\right] \quad (1)$$

Where:

$\gamma_i$ is the activity coefficient of component i (waxy component)

$x_i$ is the mole fraction of component i $\Delta H_{fus}$ is the heat of fusion for the waxy component i $\Delta C_p$ is the heat capacity of liquid i less the heat capacity of solid i $T_m$ is the normal melting point of pure component i $T_f$ is the temperature where i solidifies in the mixture Preferred blend stocks of this invention remain liquid in their entirety when mixed with light syncrude at temperatures down to −20° C. If the blend stocks precipitate from solution, the blend stocks undesirably would add to the pour point problem.

Preferred blend stocks also provide reductions in pour point temperatures as necessary to meet market demands. The blend stock has an average molecular weight less than the average molecular weight of the light syncrude, preferably less than 200, and more preferably less than 160. The blend stock is preferably selected from the group consisting of hydrocarbons, oxygenates and combinations thereof.

Improved freezing point depression can be obtained by using blend stocks with lower average molecular weights and with structures that lead to lower activity coefficients for the "waxy component" having a tendency to precipitate from solution. Example 3 provides data on the performance of several blend stocks.

Preferred blend stocks provide both the required freezing point depression and good engine performance with low emissions, including low particulate emissions, in CI engines. Preferred mixtures have a cetane number >35 and most preferably >45. Example 4 reports cetane numbers for several mixtures.

Hydrocarbons

Hydrocarbons of $C_5$ to $C_9$ are most effective for pour point depression of light syncrude both because they largely do not change activity coefficients when added to hydrocarbon mixtures and because their low molecular weight leads to relatively large reductions in the mole fractions of the waxy components for a given mass fraction of these blend stocks. Higher carbon number hydrocarbons are not as effective for diluting mole fractions of waxy components. Lower carbon number hydrocarbons lead to increased volatility which is undesirable. Sources of hydrocarbon blend stocks include products and intermediates of petroleum refineries and refined syncrude. Others include $C_5$–$C_9$ alkanes, e.g., hexane, gasoline, biodiesel and naphtha. C5 to C13 branched hydrocarbons are also very effective as blend stocks to lower the pour point temperature.

Oxygenates

The oxygenate is preferably selected from alcohols, ethers and combinations thereof. For the embodiments of this invention, oxygenates are preferably compounds comprised of carbon, oxygen, and hydrogen where the ratio of carbon atoms to oxygen atoms is >1.5 and the ratio of hydrogen atoms to carbon atoms is >1.5. These oxygenates provide highly desirable performance characterized by a reduction in both $NO_x$ and particulate matter relative to US 1-D (diesel) fuel.

From a performance perspective, preferred oxygenates include ethers comprised solely of carbon, oxygen, and hydrogen and having a carbon number less than 10. These preferred ethers include diethyl ether as well as other ethers commonly added to gasoline. These ethers are both effective at reducing pour point temperatures and reducing particulate emissions. Most preferred mixtures, from a performance perspective, contain from 5% to 35% ether by mass.

A disadvantage of ether blend stocks is their cost. From an economic perspective, preferred oxygenates include alcohols comprised solely of carbon, oxygen, and hydrogen and having a carbon number less than 10. A preferred alcohol is ethanol. Ethanol is effective at reducing particulate emissions, but is not as effective as the ethers for reducing pour point temperatures. Most preferred mixtures, from an economic perspective, contain from 5% to 35% ethanol by mass.

When either an alcohol or ether is present, the alcohol or ether is preferably present in an amount ranging from about 5 to about 35 mass %. When the alcohol and ether are both present, they are preferably present in substantially equal mass amounts, with the total amounts thereof ranging from about 5 to about 40 mass %. When an oxygenate and a pour point depressant are both present, the pour point depressant is preferably present in an amount ranging from about 0.01 to about 0.05 mass %.

Examples 1 and 2 provide data on the impact of several blend stocks on emissions with the following trends:

Blend stocks with increased volatility generally result in increased hydrocarbon emissions.

Light syncrude as well as mixtures comprised mostly of light syncrude resulted in decreased $NO_x$ emissions.

Addition of oxygenated blend stocks leads to reduced particulate matter emissions.

Pour Point Depressants

In addition to using the blend stocks for depressing the pour point of the composition, commercially available pour point depressants that are designed for applications with petroleum-based diesel are also effective for reducing pour point temperatures of the compositions of the present invention. Examples of such commercially available pour point depressants include MCC 8092 and MCC 8094 available from Midcontintental Chemical Company. When present, the pour point depressant is present in amount less than 0.5 mass % (5000 ppm) can be added to reduce the pour point temperature of the composition. More preferred embodiments of the present invention use from about 200 to about 1000 ppm of the pour point depressant to reduce the pour point temperatures of the composition. In a mixture of 30% gasoline with light syncrude, adding from about 900 to about 1000 ppm of a pour point depressant reduced the pour point temperature of the composition by about 15° C. (see Example 3).

Cloud points and pour points are evaluated using ASTM standards D-2500 and D-97. The cloud point temperature is believed to indicate the temperature at which solid crystals from precipitating "waxy" hydrocarbons become visible. The pour point temperature is believed to be the temperature where sufficient solids have precipitated to prevent flow as based on the definition by ASTM standard D-97. Pour point depressants reduce pour points by changing the morphology of the crystals precipitating from the liquid phase. In some cases, pour point depressants promote the formation of smaller crystals that flow better than larger needle-shaped crystals that form in the absence of pour point depressants.

Carbon-containing Compound Which Reacts With Water

In the alternative or in addition to the use of an emulsifier, a carbon-containing compound which reacts with water may be added to the composition. The carbon-containing compound is preferably an anhydride, more preferably acetic anhydride. When present, the anhydride is preferably present in an amount ranging from about 0.01 to about 0.5 mass %.

Cetane Improvers

The cetane number of the composition is preferably greater than 35 and more preferably greater than 45. A cetane improver may be added to achieve the desired cetane number. When present, the cetane improver is preferably present in an amount ranging from about 0.01 to about 0.5 mass %. The cetane improver preferably has a greater solubility in ethanol than in hexane.

Emulsifiers

In order to minimize the adverse performance effects of a phase separation when water is present in the composition, an emulsifier may be added to the composition. In such a situation, the emulsifier is preferably present in an amount ranging from about 0.01 to about 0.5 mass %.

Fuel Composition

For purposes of analyzing the suitability of the fuels of this invention, three performance criteria were evaluated, including:

1. Pour Point Temperature—Since vehicles are typically not equipped with heaters for the fuel delivery system, a diesel fuel preferably should flow under the force of gravity to the pump intake in the fuel tank. The pour point temperature is representative of the temperature where this flow stops. Reductions in pour point temperatures translate to larger potential fuel markets by inclusion of markets at cooler geographical regions and markets during cooler periods of the year. It is desirable to have fuels with low pour point temperatures, preferably lower than −20° C.
2. Cetane Number—Cetane numbers correlate directly with engine operability. Preferred fuels have cetane numbers greater than 35.
3. Engine Operability and Emissions—Engine operability is the ultimate test for a fuel. Operability with low emissions is preferred. However, these alone are not sufficient—the fuel should also meet minimum pour point criteria. Preferred fuels would have lower $NO_x$ and particulate emissions than US 1-D fuel.

The prominent embodiments of this invention provide compositions of matter to meet performance needs based on these three criteria.

Accordingly, there is provided a compression-ignition fuel composition, wherein the composition comprises from about 30 to about 95 mass % of a light syncrude and from about 70 to about 5 mass % of a blend stock, wherein the blend stock has an average molecular weight less than the average molecular weight of the light syncrude. The composition may optionally also contain a pour point depressant, a cetane improver, a carbon-containing compound which reacts with water, and/or an emulsifier. When present, the pour point depressant is present in amount less than 0.5 mass %.

In one embodiment of the present invention, the light syncrude is present as a major portion of the composition and the blend stock is present as a minor portion of the composition. In a preferred embodiment, the light syncrude ranges from about 60 to about 95 mass % of the composition and the blend stock ranges from about 5 to about 40 mass % of the composition. The light syncrude preferably has an average carbon number from about 8 to about 20 and a standard deviation around that carbon number of greater than 1.5 carbon numbers. The blend stock preferably has an average molecular weight less than 200, and more preferably less than 160. The blend stock is preferably selected from the group consisting of hydrocarbons, oxygenates and combinations thereof.

The oxygenate is preferably selected from alcohols, ethers and combinations thereof. The alcohols and ethers preferably each have a carbon number less than 10. A preferred alcohol is ethanol. The ethers are any of those commonly used in gasoline formulations. A preferred ether is diethyl ether. When either an alcohol or ether is present, the alcohol or ether is preferably present in an amount ranging from about 5 to about 35 mass %. When the alcohol and ether are both present, they are preferably present in substantially equal mass amounts, with the total amounts thereof ranging from about 5 to about 40 mass %. When an oxygenate and a pour point depressant are both present, the pour point depressant is preferably present in an amount ranging from about 0.01 to about 0.05 mass %.

The cetane number of the composition is preferably greater than 35 and more preferably greater than 45. A cetane improver may be added to achieve the desired cetane number. When present, the cetane improver is preferably present in an amount ranging from about 0.01 to about 0.5 mass %. The cetane improver preferably has a greater solubility in ethanol than in hexane.

In another embodiment, the composition contains greater than 50 mass % of a light syncrude and less than 50 mass % of an oxygenate, wherein the oxygenate has a lower average molecular weight than the light syncrude. Preferably, the composition contains substantially equal masses of ethanol and diethyl ether and the light syncrude is present in an amount ranging from about 60 to about 90 mass %.

In another embodiment, the composition contains from about 60 to about 80 mass % of a light syncrude, from about 7.5 to about 30 mass % of ethanol, and from 0 to about 20 mass % of an ether, wherein the ether is preferably diethyl ether.

In another embodiment, the composition contains greater than 50 mass % of a light syncrude and less than 50 mass % of a blend stock which is a mixture of $C_5$ to $C_9$ hydrocarbons.

Overcoming Liquid-Liquid Phase Behavior Problems in Mixtures with Ethanol

Preferred mixtures with ethanol or other alcohols resist formation of two separable liquid phases when small amounts (<1:100 of mass of water to mass of fuel mixture) of water are contacted with the mixture. In order to minimize the adverse performance effects of a phase separation when water is present in the composition, an emulsifier may be added. The emulsifier is a proactive additive that has little or no impact when the fuel is in a preferred homogeneous phase and is activated when water is contacted with the fuel. The emulsifier reduces the average size of aqueous phases formed and therein slows down or largely prevents the formation of a water-rich phase that can be isolated from the fuel-rich phase. In such a situation, the emulsifier is preferably present in an amount ranging from about 0.01 to about 0.5 mass % In the alternative or in addition to the use of an emulsifier, a carbon-containing compound which reacts with water may be added. The carbon-containing compound is preferably an anhydride, more preferably acetic anhydride. When present, the anhydride is preferably present in an amount ranging from about 0.01 to about 0.5 mass %.

Alternatively, acceptable performance can be obtained with mixtures that form two liquid phases where both liquids are compatible with diesel engine operation. Upon liquid-liquid phase separation, the alcohol and water rich liquid is the liquid likely to cause problems with engine operation. A preferred method of overcoming these engine operation problems is to add cetane improvers to the mixture. Preferred cetane improvers exhibit partition coefficients that distribute the cetane improver selectively into the alcohol and water rich phase. Preferred cetane improvers with this performance include but are not limited to polyethylene glycol dinitrates, fatty acid nitrates, triglyceride nitrates, biodiesel nitrates, and water-soluble adducts of polyol. Most preferred cetane improvers have both cetane improving capabilities and emulsifying capabilities.

Preferred mixtures contain ethanol and cetane improvers such that the mass ratio of ethanol to cetane improvers is between 10 and 500.

These methods of overcoming liquid-liquid phase behavior problems are not limited to fuels containing mostly light syncrude. Use of emulsifiers, compounds that react with water, and cetane improvers having greater solubilities in ethanol than in hexanes may also be used in mixtures of petroleum-based diesel and ethanol. For this alternative embodiment, the hydrocarbon content is preferably between 60 and 95 mass % (% by mass), the oxygenate content is preferably between 5 and 40 mass %, and said additives are preferably 0.05 to 1 mass %.

The most preferred embodiments of this invention are fuel compositions containing from about 70 to about 95 mass % of a light syncrude that has improved chemical diversity, from about 5 to about 30 mass % of a blend stock (preferably ethanol), from about 150 to about 800 ppm of a pour point depressant, and from about 1000 to about 5000 ppm of a cetane improver, wherein the cetane improver partitions into an ethanol-rich phase over a hydrocarbon-rich phase. Preferably, the cetane improver is a difunctional additive which has both cetane-improving and emulsifying capabilities. Advantages of this fuel composition include smooth operation in compression-ignition engines, low particulate emissions relative to US 1-D fuel, and production capabilities from a variety of resources including natural gas, coal, biomass, and organic refuse.

Examples 1 and 2 describe engine tests on a Detroit Diesel 453T, off-road engine where the light syncrude successfully powered the diesel engine with hydrocarbon emissions slightly higher than US 1-D fuel and with particulate matter and $NO_x$ emissions 0–20% lower than US 1-D fuel.

EXAMPLES

Experimental Methods

The experimental methods used in the Examples hereof are described in the following paragraphs.

a) Cetane Number

The cetane number is a measure of a fuel's ignition quality. A high cetane number corresponds to low ignition delay times (better ignition quality). Ignition delay times are known to correlate well with cetane numbers and were directly measured alternative to using a cetane engine. Ignition delay time data also provide a more fundamental basis for interpreting trends in the data. A detailed description of the equipment can be found elsewhere (Suppes et. al., 1997a and 1997b). Allard et. al. (1996, 1997) details preferred operating procedures for constant volume combustors.

To determine the cetane number of the test fuels, ignition delay time results were compared to data for U-13 and T-20 test fuels. Three mixtures were used corresponding to cetane numbers of 30.0, 45.3, and 60.1. The tests were carried out at temperatures of 750, 800, and 833 or 850 K. Approximately six ignition delay times were measured at each temperature.

Thompson et. al. (1997) conducted an extensive study of cetane number estimation methods. They found that the recommended ASTM D-613 cetane number method had repeatabilities and reproducibilities that steadily increased with the value of the cetane number being measured. At a cetane number of 40 would typically have a repeatability and reproducibility of 0.8 and 2.8 while a cetane number of 56 would have respective values of 0.9 and 4.8.

Although ignition delay times were measured at three temperatures, only the 800 K data were used to estimate cetane numbers. Standard deviations are reported for the 800 K data. Since six measurements typically were taken at 800 K, the 95% confidence interval is about 0.8 times the reported standard deviations. These 95% confidence intervals were typically between corresponding repeatability and reproducibility values reported by Thompson et. al. (1997).

b) Kinematic Viscosity

The kinematic viscosities of test fuels were tested by the ASTM D 445 method. For this test a Cannon-Fenske Routine size 50 capillary viscometer was used. The kinematic viscosity of each fuel was measured at 40° C.

The test requires that the viscometer must be placed in a temperature-controlled bath with the sample being no closer than 20 mm from the top or bottom of the bath. The test fuels were placed in the viscometer with the fluid level 7 mm above the first timing mark. The test fuel was then allowed to flow down the capillary tube being timed between the first timing mark and the final timing mark. Two runs of this experiment were made with the reported time being the average.

The kinematic viscosity (v) was then calculated by the following equation:

$$v=C*t \quad (3)$$

v=kinematic viscosity, $mm^2/s$

C=calibration constant of the viscometer, $(mm^2/s)/s$ t=mean flow time, s.

The calibration constant of the viscometer was found by using two certified viscosity standards and by comparison with the measured values of ethanol and water. This gave an accurate calibration equation for the determination of the test fuel's viscosities.

c) Cloud Point

The cloud point is related to the temperature when the fuel begins to form wax crystals, causing a cloudy appearance in the mixture. A FTS Systems chiller capable of controlled bath temperatures down to −80° C. was used to gradually lower the temperature of the test fuel until the cloud point was reached. ASTM D 2500 cloud point and ASTM D 97 pour point procedures were followed with the exception that 5 ml vials were used rather than 100 ml beakers due to the limited supply of syncrude.

The test fuel was placed in a small clear vial and brought to within 14° C. of the expected cloud point in the temperature-controlled chiller. The chiller was cooled in one-degree intervals. The sample was then carefully and quickly removed at each interval and inspected for the cloud point transition. Care must be taken not to disturb the sample since perturbations could lead to low, inaccurate cloud point temperature observations. The cloud points were reported to the nearest 1° C. The samples were then further cooled to measure pour point temperatures.

d) Pour Point

The pour point is the temperature at which the fuel no longer flows. This test method requires the same testing procedure as described for cloud point determination. At every interval of 1° C., the sample was quickly and carefully removed and inspected. When inspecting the sample, the test vial was tilted just far enough to detect movement of the fluid. When the sample cooled to the point where it no longer showed movement, the test jar was then tilted horizontally and held for 5 s. If the sample moved the procedure was continued. If no movement was observed the pour point had been reached. The pour point was then reported to the nearest 1° C. Since the relatively small test samples would experience greater wall effects than the recommended 100 ml samples, the pour point values may be slightly high.

Materials a) Fuel Sources

Fischer-Tropsch Samples

The light syncrude used was a fraction of a Fischer-Tropsch product that was separated from the waxy components. The syncrude distillate (also referred to as syncrude diesel distillate) used was a fraction of the light syncrude. Neither product has been hydrocracked.

Figure 2:
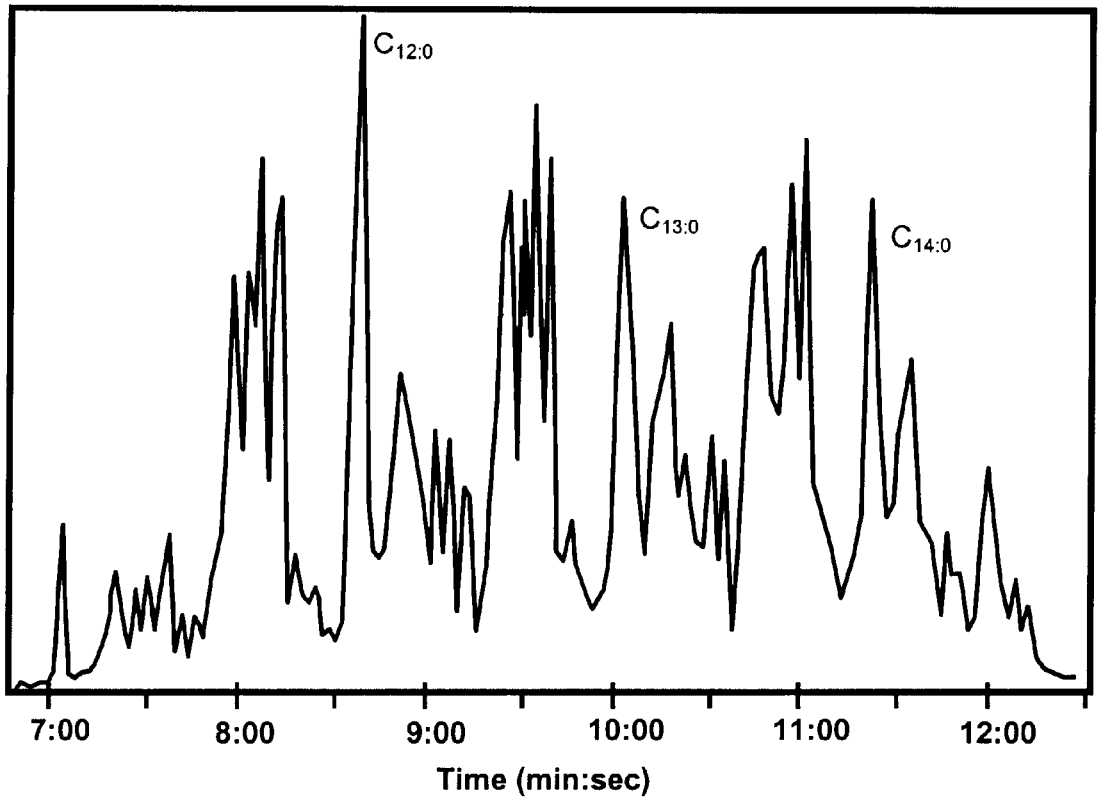
FIG. 2 is a GC-MS of a syncrude distillate (also referred to as syncrude diesel distillate) used in the Examples hereof.

A gas chromatography equipped with a mass spectrometer detector (GC-MS) was used to determine product distributions for both the light syncrude and the distillate, see FIGS. 1 and 2, respectively.

The largest peak of the light syncrude is at 238 s and corresponds to a straight chain, $C_{12:0}$ paraffin. Immediately to the left and approximately one third in magnitude of the $C_{12:0}$ paraffin peak is the corresponding $C_{12:1}$ olefin peak. This pairing is consistent throughout the chromatograph starting at about 90 s for $C_{9:0}$ and $C_{9:1}$ and rapidly tapering off at 590 s with the $C_{24:0}$ peak.

The chromatograph of the distillate is more difficult to interpret, possibly due to oxidation which occurred during fractionation (such oxidation would be largely eliminated upon scaleup). The maximum masses of species corresponding to peaks at 234, 273, and 307 s are 170, 184, and 198 respectively indicating that these peaks are the $C_{12:0}$, $C_{13:0}$, and $C_{14:0}$ paraffins. The other peaks are believed to be olefins and oxygenates of the syncrude with would fractionate at the same temperatures as the $C_{12:0}$ to $C_{14:0}$ paraffins.

b) Other Chemicals

Ethanol, diethyl ether, biodiesel, hexanes, and gasoline were used as fuels to dilute light syncrude. Ethanol and diethyl were obtained at purities >99.8%. The biodiesel used was a methyl ester of soybean oil and was obtained from the National Biodiesel Board. HPLC grade hexanes were obtained from Aldrich. The 87-octane gasoline was obtained locally. The diesel was obtained in a summer grade of low cetane quality. The pour point depressants, MCC 8092 (UI-8092) and MCC 8094 (UI-8094), were obtained from the Mid-Continental Chemical Company.

Example 1

Engine Demonstration and Emissions Monitoring

This light syncrude had a pour point temperature near 0° C., an average carbon number of about 12, a composition comprised of about 70% n-paraffins and about 29% 1-alkenes with >90% of the hydrocarbons having carbon numbers between $C_8$ and $C_{22}$. Table 1 summarizes data of this light syncrude (designated syncrude or SC) as well as mixtures of light syncrude containing 25% gasoline, 25% hexane, or 25% of an equal mass mixture of ethanol and diethyl ether. The light syncrude mixtures had lower NO emissions. Light syncrude mixtures with oxygenates (ethanol and diethyl ether) had substantially lower particulate emissions. For these tests, fuels were changed while the Detroit Diesel 453T engine was operating at constant loads of 40% and 80% of maximum torque at 1500 rpm.

TABLE 1

Summary of emissions from first two tests at 40% and 80% loads and 1500 rpm. Carbon monoxide emissions are reported in percent, carbon dioxide emissions are reported in mass fraction, hydrocarbon (HC) emissions are reported in ppm, nitrogen oxide emissions are reported in ppm, oxygen emissions are reported in percent, temperature is reported in degrees Kelvin, and particulate matter (PM) is reported in percent based on milligrams collected using the test fuel relative to diesel as collected on a 47 mm laminated 1.0 micron filter for the same time and flow rate as the diesel sample.

| | CO | CO2 | HC | NO | O2 | T | PM |
|---|---|---|---|---|---|---|---|
| April 22nd | | | | | | | |
| 40% Diesel | XX | 0.060 | 47 | 615 | 17.1 | 280 | |
| Syncrude (SC) | XX | 0.058 | 77 | 555 | 17.1 | 282 | 100.0% |
| SC + 25% Gasoline | XX | 0.058 | 115 | 557 | 17.0 | 282 | 90.0% |
| Diesel | XX | 0.061 | 50 | 628 | 17.0 | XX | 100.0% |
| SC + 25% EtHO/DEE | XX | 0.056 | 116 | 577 | 17.3 | 287 | 70.0% |
| 80% Diesel | 0.12 | 0.084 | 72 | 750 | 14.5 | 284 | 93.4% |

TABLE 1-continued

Summary of emissions from first two tests at 40% and 80% loads and 1500 rpm. Carbon monoxide emissions are reported in percent, carbon dioxide emissions are reported in mass fraction, hydrocarbon (HC) emissions are reported in ppm, nitrogen oxide emissions are reported in ppm, oxygen emissions are reported in percent, temperature is reported in degrees Kelvin, and particulate matter (PM) is reported in percent based on milligrams collected using the test fuel relative to diesel as collected on a 47 mm laminated 1.0 micron filter for the same time and flow rate as the diesel sample.

| | CO | CO2 | HC | NO | O2 | T | PM |
|---|---|---|---|---|---|---|---|
| Diesel | 0.11 | 0.078 | 56 | 768 | 15.0 | 289 | 106.6% |
| Syncrude (SC) | 0.11 | 0.072 | 98 | 847 | 15.4 | 289 | 80.7% |
| SC + 25% Hexanes | 0.10 | 0.068 | 133 | 621 | 15.6 | 288 | 68.0% |
| SC + 25% EtHO/DEE | 0.09 | 0.075 | 132 | 655 | 14.9 | 287 | 55.3% |
| April 15th | | | | | | | |
| 40% Diesel | 0.011 | 0.060 | 55 | 584 | 16.8 | | |
| Syncrude(SC) | 0.013 | 0.057 | 85 | 516 | 16.9 | | |
| SC + 25% Hexanes | 0.011 | 0.057 | 131 | 520 | 16.8 | | |
| SC + 25% Gasoline | 0.014 | 0.056 | 135 | 526 | 16.9 | | |
| SC + 25% EtHO/DEE | 0.011 | 0.058 | 135 | 539 | 16.9 | | |
| Diesel | 0.009 | 0.059 | 61 | 583 | 16.9 | | |

Example 2

Repeat of Engine Demonstration and Emissions Monitoring

Tables 2 and 3 present supplementary data on the performance of Mixtures of Fischer-Tropsch fuels with blend stocks. Particulate emissions decreased by as much as 70% in mixtures with ethanol blend stock. In Table 2, SC is light syncrude, "gas" is 87-octane gasoline, Et is ethanol, DE is diethyl ether, and Et/DE is a substantially equal mass mixture of ethanol and diethyl ether. In Table 3, Syncrude is light syncrude, "gasoline" is 87-octane gasoline, EtOH is ethanol, DEE is diethyl ether, and EtOM/DEE is a substantially equal mass mixture of ethanol and diethyl ether.

TABLE 2

Summary of impact of fuel on particulate emissions.

| | LOAD | | LOAD | |
|---|---|---|---|---|
| | 50% mg | 80% mg | 50% % | 80% % |
| US 2-D | 0.67 | 1.46 | 151.4% | 87.8% |
| US 1-D | 0.44 | 1.66 | 100.0% | 100.0% |
| 25% gas/SC | 0.53 | 1.29 | 119.8% | 77.3% |
| SC | 0.42 | 1.36 | 94.9% | 81.5% |
| 20% Et/SC | 0.26 | 0.84 | 59.9% | 50.8% |
| 25% Et/SC | 0.22 | 0.62 | 50.8% | 37.3% |
| 33% Et/DE/SC | 0.32 | 0.52 | 72.3% | 31.0% |
| 20% Et/DE/SC | 0.31 | 0.81 | 70.1% | 48.7% |

Example 3

Pour Point Temperature Reduction

Table 4 summarizes pour point and cloud point data for mixtures with light syncrude as well as reference fuels. Typical cold flow requirements include cold-flow performance down to a maximum of 2° C. above the ASTM D 975 tenth percentile minimum ambient air temperature charts and maps. Even at 0° C., light syncrude has sufficient flow characteristics for many parts of the world for most of the year. As illustrated by the data of Table 1, pour point depressants and blend stocks can be used to improve flow properties as needed depending upon location.

TABLE 3

Summary of gas phase analysis of engine exhaust.

| | Target Speed | Load % | CO2 % | HC (ppm) | NO (ppm) | O2 % | Speed (rpm) | Torque (ft/lb) | T (C) |
|---|---|---|---|---|---|---|---|---|---|
| Start Calibration, zero gas | (rpm) | | 0.1 | 0 | 0 | 0.0 | −5 | −1 | 21.2 |
| Start Calibration, span gas | | | 30.1 | 902 | 897 | 21.0 | | | 21 |
| End Calibration, zero gas | | | 0.3 | 4 | 0 | 0.1 | −4 | −1 | |
| End Calibration, span gas | | | 30.1 | 882 | 876 | 20.0 | | | |
| | | | 0.3 | 1 | | | | | |
| 1-US 2D diesel | rated | 100% | 10.0 | 87 | 872 | 12.8 | 2140 | 389 | 287 |
| 1-US 2D diesel | rated | 100% | 10.0 | 79 | 928 | 12.9 | 2076 | 397 | 288 |
| 1-US 2D diesel | rated | 75% | 8.6 | 69 | 757 | 14.6 | 2305 | 291 | 289 |
| 1-US 2D diesel | rated | 50% | 7.0 | 61 | 617 | 16.4 | 2320 | 190 | 289 |
| 1-US 2D diesel | rated | 10% | 3.4 | 66 | 198 | 20.6 | 2385 | 41 | 223 |
| 1-US 2D diesel | 1500 | 80% | 7.3 | 51 | 692 | 16.0 | 1465 | 313 | 289 |
| 1-US 2D diesel | 1500 | 50% | 6.4 | 48 | 677 | 17.2 | 1507 | 202 | 289 |
| 1-US 2D diesel | 1500 | 0% | 1.5 | 57 | 113 | 22.9 | 1613 | 9 | 155 |
| 2-US 1D diesel | 1500 | 80% | 7.3 | 79 | 622 | 16.1 | 1454 | 308 | 289 |
| 2-US 1D diesel | 1500 | 50% | 6.2 | 75 | 609 | 17.4 | 1502 | 200 | 289 |
| 2-US 1D diesel | 1500 | 0% | 2.0 | 92 | 133 | 22.3 | 1618 | 8 | 154 |
| 3-Syncrude + 25% gasoline | 1500 | 80% | 6.9 | 178 | 548 | 16.3 | 1468 | 302 | 289 |
| 3-Syncrude + 25% gasoline | 1500 | 50% | 6.0 | 171 | 576 | 17.5 | 1500 | 199 | 290 |
| 3-Syncrude + 25% gasoline | 1500 | 0% | 1.8 | 189 | 125 | 22.4 | 1639 | 8 | 162 |
| 4-Syncrude | 1500 | 80% | 6.9 | 122 | 550 | 16.2 | 1440 | 307 | 290 |
| 4-Syncrude | 1500 | 50% | 6.6 | 124 | 544 | 16.5 | 1448 | 301 | 290 |
| 4-Syncrude | 1500 | 50% | 5.9 | 124 | 523 | 17.5 | 1485 | 199 | 290 |
| 4-Syncrude | 1500 | 0% | 1.9 | 136 | 144 | 22.4 | 1600 | 8 | 161 |

TABLE 3-continued

Summary of gas phase analysis of engine exhaust.

| | Target Speed | Load % | CO2 % | HC (ppm) | NO (ppm) | O2 % | Speed (rpm) | Torque (ft/lb) | T (C) |
|---|---|---|---|---|---|---|---|---|---|
| 5-Syncrude + 20% EtOH | 1500 | 80% | 6.4 | 164 | 545 | 16.6 | 1469 | 303 | 290 |
| 5-Syncrude + 20% EtOH | 1500 | 50% | 5.5 | 177 | 564 | 17.8 | 1520 | 195 | 290 |
| 5-Syncrude + 20% EtOH | 1500 | 0% | 1.6 | 217 | 99 | 22.5 | 1619 | 8 | 151 |
| 6-Syncrude + 33% EtOH/DEE | 1500 | 80% | 6.3 | 218 | 567 | 16.9 | 1497 | 301 | 290 |
| 6-Syncrude + 33% EtOH/DEE | 1500 | 50% | 5.5 | 272 | 559 | 17.9 | 1529 | 195 | 289 |
| 6-Syncrude + 33% EtOH/DEE | 1500 | 0% | 1.7 | 267 | 84 | 22.4 | 1650 | 7 | 153 |
| 7-Syncrude + 20% EtOH/DEE | 1500 | 80% | 6.3 | 159 | 560 | 16.9 | 1465 | 301 | 286 |
| 7-Syncrude + 20% EtOH/DEE | 1500 | 50% | 5.5 | 166 | 586 | 17.9 | 1513 | 199 | 264 |
| 7-Syncrude + 20% EtOH/DEE | 1500 | 0% | 1.7 | 187 | 102 | 22.4 | 1101 | 7 | 140 |
| 8-Syncrude + 25% Ethanol | 1500 | 80% | 6.6 | 154 | 553 | 16.6 | 1467 | 307 | 289 |
| 8-Syncrude + 25% Ethanol | 1500 | 50% | 5.6 | 168 | 576 | 18.0 | 1516 | 196 | 290 |
| 8-Syncrude + 25% Ethanol | 1500 | 0% | 1.8 | 145 | 106 | 22.8 | 569 | 5 | 131 |
| 9-Syncrude | 1500 | 80% | 6.2 | 130 | 546 | 17.0 | 1485 | 303 | 290 |
| 9-Syncrude(NO) | 1500 | 50% | 5.5 | 119 | 555 | 18.0 | 1530 | 197 | 290 |
| 9-Syncrude(NOx) | 1500 | 50% | 5.4 | 122 | 584 | 18.1 | 1528 | 195 | 290 |
| 9-Syncrude | 1500 | 0% | 1.9 | 122 | 133 | 22.4 | 1660 | 7 | 153 |
| 10-US 1D diesel | 1500 | 80% | 6.5 | 91 | 597 | 16.9 | 1479 | 310 | 290 |
| 10-US 1D diesel | 1500 | 50% | 5.6 | 82 | 608 | 18.1 | 1510 | 196 | 290 |
| 10-US 1D diesel | 1500 | 0% | 1.9 | 93 | 128 | 22.4 | 1637 | 8 | 150 |

TABLE 4

Cloud and pour point temperatures of test fuels. All temperatures are in ° C.

| | Cloud Point | Pour Point |
|---|---|---|
| Regular Diesel | −10 | −13 |
| Synthetic Diesel | −50 | −54 |
| Distillate | | |
| Light Syncrude | 6.5 | 2 |
| Light Syncrude/EtOH | | |
| % EtOH | | |
| 10 | 6.5 | 3 |
| 20 | 6.5 | 2 |
| 30 | 6.5 | 3 |
| Biodiesel | −4 | −6 |
| Light Syncrude/Biodiesel | | |
| % Biodiesel | | |
| 10 | 5 | 1 |
| 20 | 4 | 0 |
| 30 | 4 | 0 |
| Light Syncrude/ Biodiesel/EtOH | | |
| 80/10/10 | 5 | 1 |
| 70/10/20 | 5 | 2 |
| 70/20/10 | 5 | 2 |
| Light Syncrude/Gasoline | | |
| Gasoline (87 octane) | | |
| % Gasoline | | |
| 30 | −2 | −6 |
| 30% Gas. with Pour Point Depressant | | |
| UI8092 130 ppm | −2 | −9 |
| UI8092 320 ppm | −2 | −17 |
| UI8092 520 ppm | −2 | −19 |
| UI8092 950 ppm | −2 | −21 |
| UI8094 150 ppm | −2 | −8 |
| UI8094 240 ppm | −2 | −12 |
| UI8094 460 ppm | −2 | −18 |
| UI8094 850 ppm | −2 | −21 |

TABLE 4-continued

Cloud and pour point temperatures of test fuels. All temperatures are in ° C.

| | Cloud Point | Pour Point |
|---|---|---|
| Light Syncrude/Hexanes | | |
| % Hexanes | | |
| 30 | −3 | −12 |
| Light Syncrude/Diethyl ether | | |
| % Diethyl ether | | |
| 30 | −2 | At −10° C. solids settled |

Example 4

Cetane Number Analysis

Table 5 summarizes cetane number estimates for mixtures of light syncrude with several blends. The high cetane number of light syncrude allows blending with several different blend stocks while maintaining cetane numbers above 40 which is preferred in the United States. These additives reduce pour points—it is important that the cetane numbers are not compromised while using blend stocks to achieve pour point goals.

TABLE 5

Calculated numbers of test fuels based on T and U reference fuels. All mixtures are with light syncrude and percentages in mass %. Standard deviations (std) are based on 800K data.

| | T (K) | delay t (ms) | std (ms) | CN Calc. | Calc. std (CN) |
|---|---|---|---|---|---|
| Standards and Test Fuels | | | | | |
| 30 CN | 800 | 11.5 | 0.47 | 30.0 | 1.2 |
| 45.3 CN | 799 | 7.3 | 0.51 | 45.3 | 2.6 |
| 60.1 CN | 800 | 5.2 | 0.17 | 60.2 | 1.5 |
| Diesel | 800 | 9.3 | 0.86 | 36.9 | 2.9 |

TABLE 5-continued

Calculated numbers of test fuels based on T and U reference fuels. All mixtures are with light syncrude and percentages in mass %. Standard deviations (std) are based on 800K data.

| | T (K) | delay t (ms) | std (ms) | CN Calc. | Calc. std (CN) |
|---|---|---|---|---|---|
| Syncrude Dist. | 800 | 4.8 | 0.20 | 64.3 | 2.0 |
| L Syncrude | 800 | 4.5 | 0.37 | 67.4 | 4.0 |
| Ethanol Mixtures (% ethanol indicated) | | | | | |
| 10% | 801 | 5.5 | 0.31 | 57.9 | 2.5 |
| 20% | 800 | 7.4 | 0.82 | 45.1 | 3.9 |
| 30% | 800 | 10.6 | 1.23 | 32.5 | 3.3 |
| Biodiesel Mixtures (% biodiesel indicated) | | | | | |
| 10% | 800 | 4.4 | 0.54 | 68.6 | 5.9 |
| 20% | 800 | 4.9 | 0.72 | 63.5 | 6.6 |
| 30% | 799 | 5.6 | 0.52 | 57.0 | 4.0 |
| Gasoline Mixture (% gasoline indicated) | | | | | |
| 30% | 800 | 4.9 | 0.26 | 63.3 | 2.5 |
| Light Syncrude/ Biodiesel/Ethanol | | | | | |
| 80/10/10 | 800 | 4.0 | 0.24 | 73.4 | 3.2 |
| 70/20/10 | 800 | 4.3 | 0.27 | 69.6 | 3.2 |
| 70/10/20 | 800 | 5.4 | 0.37 | 58.4 | 3.0 |

A curve correlating cetane number with ignition delay time was prepared by preparing mixtures of Phillips' U-13 and T-20 test fuels as specified by Phillips Petroleum. Such correlations are considered valid for a period of about two weeks when the data are evaluated by the same researcher. It is common for reproducibility errors to be >2.8 cetane numbers (Henly, 1997) when using ASTM D-613 evaluation methods—for this reason, periodic comparison to reference fuels is recommended when evaluating cetane numbers.

The synthetic diesel distillate (syncrude dist.) has a cetane number of 65.3±2.4, which is slightly lower than the syncrude which has a cetane number of 69±4.8. The synthetic fuels displayed impressively high cetane numbers, sufficiently high to allow blending with low cetane fuels to obtain a better combination of cetane number and pour point. When light syncrude is blended with fuels of lower cetane number it would be expected to lower the cetane number of the mixture; this is what happened with the addition of ethanol to the syncrude. In general, the trends of cetane numbers versus composition was consistent for all mixtures although some of the biodiesel mixtures performed better than expected.

As expected, the addition of ethanol markedly lowers the cetane numbers of the light syncrude. Even at 20% ethanol, the cetane number barely meets performance expectations for diesel fuels. The impact of ethanol on mixture cetane numbers would be expected to level off and asymptotically approach a value of about 12 for neat ethanol The biodiesel mixtures showed an almost linear impact of concentration on cetane number at concentrations of 10%, 20%, and 30% ethanol—similar to ethanol but the reductions were of lower magnitude. The increase in cetane number due to the addition of 10% biodiesel to the light syncrude was unexpected. Neat biodiesel will typically have a cetane number between 40 and 55, depending upon the extent of peroxide buildup that can occur during storage. It is possible that biodiesel exhibits a cetane-related synergy at lower concentrations when mixed with light syncrude due to interactions between the peroxides and light syncrude; however, definite trends cannot be discerned when considering the standard deviations of the cetane number estimates. In any case, little performance advantage is realized when increasing the cetane number from 65 to 70 (unlike the real benefits associated with increasing the cetane number from 45 to 50).

Example 5

Kinematic viscosities of various test fuels were measured at 40° C. Table 6 shows that the synthetic fuels have viscosities similar to conventional CI fuels. Both the synthetic diesel and the synthetic crude are within ASTM guidelines with viscosities of 1.9 $mm^2/s$ and 2.3 $mm^2/s$ respectively. Trends exhibited by the addition of ethanol suggest that mixtures of 30% ethanol with light syncrude would be at the lower limit of the viscosity specification.

TABLE 5

Kinematic viscosities ($mm^2/s$) of test fuels at 40° C.

| Fuel | Kinematic Viscosity ($mm^2/s$) |
|---|---|
| Regular Diesel | 3.05 |
| Synthetic Diesel Distillate | 1.92 |
| Light Syncrude | 2.32 |
| Light Syncrude/EtOH % EtOH | |
| 10 | 2.21 |
| 20 | 2.06 |

Having thus generally described the invention and provided specific examples thereof, it is apparent that various modifications and changes can be made without departing from the spirit and scope of the present invention. It is to be understood that no undue restrictions are to be imposed by reason thereof except as defined by the following claims.

What is claimed is:

1. A compression-ignition fuel composition, the composition comprising from about 30 to about 95 mass % light syncrude and from about 70 to about 5 mass % blend stock, wherein the blend stock has an average molecular weight less than the average molecular weight of the light syncrude.

2. A composition according to claim 1, further comprising a pour point depressant.

3. A composition according to claim 2, wherein the pour point depressant is present in amount less than 0.5 mass %.

4. A composition according to claim 1, wherein the light syncrude is present as a major portion of the composition and the blend stock is present as a minor portion of the composition.

5. A composition according to claim 1, wherein the major portion ranges from about 60 to about 95 mass % of the light crude, wherein the light syncrude has an average carbon number from about 8 to about 20 and a standard deviation around that carbon number of greater than 1.5 carbon numbers, and the minor amount ranges from about 40 to about 5 mass % of the blend stock, wherein the blend stock has an average molecular weight less than 200.

6. A composition according to claim 5, wherein the blend stock is at least one hydrocarbon.

7. A composition according to claim 5, wherein the blend stock is at least one oxygenate.

8. A composition according to claim 7, wherein the at least one oxygenate is an alcohol.

9. A composition according to claim 8, wherein the alcohol is ethanol.

10. A composition according to claim 7, wherein the at least one oxygenate is an ether.

11. A composition according to claim 10, wherein the ether is diethyl ether.

12. A composition according to claim 7, wherein the at least one oxygenate is a mixture of an alcohol and an ether.

13. A composition according to claim 12, wherein the alcohol is ethanol and the ether is diethyl ether.

14. A composition according to claim 13, the composition comprising from about 65 to about 90 mass % of the light syncrude, from about 5 to about 20 mass % of ethanol and from about 3 to about 20 mass % of diethyl ether.

15. A composition according to claim 14, further comprising a pour point depressant.

16. A composition according to claim 15, wherein the pour point depressant is present in an amount ranging from about 0.01 to about 0.05 mass %.

17. A composition of matter according to claim 8, the composition comprising: from about 65 to about 95 mass % of the light syncrude and from about 5 to about 35 mass % ethanol.

18. A composition according to claim 17, further comprising a pour point depressant.

19. A composition according to claim 18, wherein the pour point depressant is present in an amount ranging from about 0.01 to about 0.05 mass %.

20. A composition according to claim 17, further comprising a cetane improver.

21. A composition according to claim 20, wherein the cetane improver is present in an amount ranging from about 0.01 to about 0.5 mass %.

22. A composition according to claim 20, wherein the cetane improver has a greater solubility in ethanol than in hexane.

23. A composition according to claim 17, further comprising an emulsifier.

24. A composition according to claim 23, wherein the emulsifier is present in an amount ranging from about 0.01 to about 0.5 mass %.

25. A composition according to claim 17, further comprising a carbon-containing compound which reacts with water.

26. A composition according to claim 25, wherein the carbon-containing compound is an anhydride.

27. A composition according to claim 26, wherein the anhydride is acetic anhydride.

28. A composition according to claim 27, wherein the acetic anhydride is present in an amount ranging from about 0.01 to about 0.5 mass %.

29. A composition according to claim 1, wherein the light syncrude has an oxygenate content of at least 1% and the blend stock is an oxygenate.

30. A composition according to claim 1, wherein the light syncrude has a branched paraffin content of at least 2%.

* * * * *